US005324250A

United States Patent [19]

Janson et al.

[11] Patent Number: 5,324,250

[45] Date of Patent: Jun. 28, 1994

[54] METHOD AND APPARATUS FOR FOLDING BOTTOM PANELS OF A CARTON BLANK

[75] Inventors: Magnus Janson, Edina, Minn.; Jonny Olander, Trelleborg, Sweden

[73] Assignee: Tetra Laval Holdings & Finance S.A., Pully, Switzerland

[21] Appl. No.: 981,115

[22] Filed: Nov. 25, 1992

[51] Int. Cl.[5] ..... B31B 3/32; B31B 3/52; B31B 3/64

[52] U.S. Cl. ..... 493/133; 493/135; 493/164; 493/183

[58] Field of Search ..... 493/121, 126, 133, 134, 493/135, 164, 175, 176, 183

[56] References Cited

U.S. PATENT DOCUMENTS

| | | | |
|---|---|---|---|
| 3,785,113 | 1/1974 | Martensson et al. | 53/186 |
| 3,999,469 | 12/1976 | Nilsson | 493/183 |
| 4,078,364 | 3/1978 | Schmidt | 53/378 |
| 5,167,607 | 12/1992 | Larsen | 493/183 |

*Primary Examiner*—William E. Terrell
*Attorney, Agent, or Firm*—Burns, Doane, Swecker & Mathis

[57] ABSTRACT

An apparatus and method for folding the bottom panels of a carton blank that includes side walls, first and third bottom panels extending from opposite side walls, second and fourth bottom panels extending from opposite side walls, and a bottom panel flap extending from the third bottom panel. The apparatus includes a frame, a rotatable supporting assembly, two rotatable folding fingers mounted on the frame for inwardly folding the second and fourth bottom panels, a tuck folder mounted on the rotatable mounting assembly for inwardly folding the third bottom panel, a guide mounted on the frame for contacting and inwardly folding the first bottom panel, and a bending member mounted on the rotatable supporting assembly for outwardly folding the bottom panel flap. One portion of the bending member is curved to define a concave surface that faces the tuck folder. The bending member can also be provided with a convex surface positioned on each side of the concave surface. The method involves placing a carton whose bottom end wall is to be formed on a rotating mandrel, folding the second and fourth bottom panels inwardly towards one another, folding the first and third bottom panels inwardly towards one another, and folding the bottom panel flap outwardly away from the first bottom panel concurrently with the inward folding of the third bottom panel. The folding of the bottom panel flap occurs without prior prefolding of the bottom panel flap.

19 Claims, 5 Drawing Sheets

METHOD AND APPARATUS FOR FOLDING BOTTOM PANELS OF A CARTON BLANK

FIELD OF THE INVENTION

The present invention pertains to an apparatus and method for forming cartons, and more particularly to a method and apparatus for folding the bottom panels of a carton blank to form the bottom end wall of a carton.

BACKGROUND OF THE INVENTION

It is known in the art to manufacture cartons for different types of contents through the use of methods and machines which convert packing material carton blanks to finished cartons that are filled with the desired contents and then closed. A carton blank is typically utilized as the starting point for the manufacture of the finished cartons. The carton blank includes first, second, third and fourth side wall panels, which form the side walls of the finished carton. Extending from the first, second, third and fourth side wall panels are first, second, third and fourth bottom panels, respectively. As will be described in more detail below, the bottom panels are appropriately folded and sealed to form the bottom end wall of the finished carton. At the opposite end of each of the side wall panels is a top panel, the details of which are known and will not be described here as they do not form a specific part of the present invention.

Before the cartons can be filled with the desired contents, it is necessary to fold and seal the bottom panels to form a sealed bottom end wall. There are known types of apparatus for forming and sealing the bottom end wall of carton blanks such as the one described above. A more detailed discussion of the features of the apparatus, as well as features of the machine that result in the filling and closing of the carton top, is set forth in U.S. Pat. No. 3,785,113 and U.S. Pat. No.4,790,123, the disclosures of which are incorporated herein by reference.

Generally speaking, carton blanks that have been formed into a generally tubular form with a substantially square cross-section are placed on feeders that comprise a continuous feeder conveyor. The feeder conveyor transports the generally tubular carton blanks to a rotatable mandrel assembly which is comprised of a plurality of radially outwardly directed mandrels. Two side-by-side feeders which each transport carton blanks to a respective rotatable mandrel assembly can be used. It is, of course, to be understood that a single feeder or more than two feeders could be employed, each of which conveys carton blanks to a respective rotatable mandrel assembly.

After a carton blank has been conveyed to the mandrel assembly and received on a respective one of the mandrels, the mandrel assembly rotates and causes the carton blank to rotate through a series of stations. As described in more detail in the aforementioned U.S. patents, a carton blank (not shown) is initially received on the mandrel from the feeder conveyor at an in-feed station. Thereafter, the mandrel is indexed one station to a heating station at which the bottom panels of the carton blank are heated by a suitable heating device. The heating device can take the form of an apparatus that directs hot air at the bottom panels. The mandrel is then indexed to the next station where the bottom panels are sealed by a suitable sealing device to form a sealed bottom end wall of the carton. While rotating from the heating station to the sealing station, the bottom panels can be subjected to a folding operation so that when the carton blank reaches the sealing station, the bottom panels can be sealed in the proper manner. A further indexing of the mandrel from the sealing station moves the carton blank to a cooling station where the sealed bottom end wall is cooled by a suitable cooling device. As an alternative to a cooling device, the bottom panels can be cooled by the surrounding ambient air. One final indexing of the mandrel causes the carton with a sealed bottom end wall to be placed on a feeder conveyor where it is intermittently advanced to various processing stations such as a filling station for filling the carton with contents and a top end closing station where the top end of the carton is closed and sealed.

Through use of a carton blank similar to that described above and an apparatus similar to that described above, the resulting sealed bottom end wall of the carton obtains a particular configuration. As seen from the carton interior, the second and fourth bottom panels are located inwardly of the first and third bottom panels with respect to the interior of the carton. Also, the first bottom panel overlaps a portion of the outer surface of the third bottom panel. Further, a portion of the edge of the third bottom panel located between the second and fourth bottom panels is exposed to the interior of the carton.

It has been found that the exposure of a portion of the edge of the third bottom panel to the interior is somewhat problematic. That is, over time, the contents in the carton tend to infiltrate the exposed edge portion of the third bottom panel, possibly causing delamination of the packing material. As a result, contamination of the carton contents may occur.

To address that problem, the carton blank described above has been modified slightly. In particular, as seen in FIG. 1, the carton blank 20 is provided with a bottom panel flap 35 that extends from the third bottom panel 34. A crease line 37 is also provided for facilitating folding of the bottom panel flap 35. During the folding operation, the bottom panel flap 35 is folded outwardly away from the first bottom panel 30 and back upon the third bottom panel 34 along the crease line 37. When the bottom panels 30, 32, 34 36 are sealed, the bottom panel flap 35 is positioned between the first bottom panel 30 and the third bottom panel 34 as illustrated in FIG. 10. In that way, an edge portion of the third bottom panel 34 is not exposed to the interior of the carton between the second and fourth bottom panels 32, 36.

In an attempt to ensure proper folding of the bottom panel flap 35, a prefolding arrangement has been provided for prefolding the bottom panel flap 35. Such a prefolding arrangement is illustrated in FIG. 2 which depicts the forward end of the feeder conveyor 40 relative to the mandrel 42 which receives the carton blank 20. The prefolding arrangement includes a carrier 52 that is mounted on the feeder conveyor 40. The carton 20 blank is positioned on the feeder conveyor 40 in front of the carrier 52, and the carrier 52 follows the carton blank 20 as it moves along the feeder conveyor 40. A fixedly mounted prefolding block 54 is also provided. The prefolding block 54 is positioned at the forward end of the feeder conveyor 40 and just in front of the position that the mandrel 42 assumes at the in-feed station for receiving the carton blank 20.

As the carton blank 20 is received on the mandrel 42, the carrier 52 begins to move downwardly as a result of the course of movement of the feeder conveyor 40. The prefolding block 54 is positioned relative to the carrier 52 such that as the carrier 52 passes by the prefolding block 54, a small clearance space is provided between the tip of the carrier 52 and the tip of the prefolding block 54. As the carrier 52 moves downwardly, it catches the bottom panel flap 35 and bends the bottom panel flap 35 around the tip of the prefolding block 54, thereby prefolding the bottom panel flap 35. Further movement of the feeder conveyor 40 moves the carrier 52 out of the way, whereupon the mandrel 42 indexes upwardly from the position illustrated in FIG. 2 to the heating station.

After the bottom panels have been heated at the heating station, the mandrel 42 is indexed to move the carton blank with the heated bottom panels towards the sealing station. To ensure that the bottom panels are properly folded before being sealed, the bottom panels are preferably brought into engagement with a bottom panel folding apparatus similar to that illustrated in FIG. 3 as the carton blank 20 is proceeding from the heating station to the sealing station.

The bottom panel folding apparatus includes a tuck folder 56 secured to a mounting arm 58, and a bending unit 62 which is also secured to the mounting arm 58. The mounting arm 58 is connected to a rotatably driven shaft 66, and encircling the shaft 66 is a shaft housing 65 that houses bearings for the shaft 66. The shaft housing 65 is mounted on a frame structure 68. Consequently, rotation of the shaft 66 results in rotation of the mounting arm 58 and consequently, rotation of the tuck folder 56 and the bending unit 62.

As can be seen from FIG. 3, the bending unit 62 includes a straight portion 62′ which is positioned perpendicular to the mounting arm 58 and a curved portion 62″ that curves toward the tuck folder 56. Also, mounted at the distal free end of the tuck folder 56 is a roller 57.

The bottom panel folding apparatus also includes two folding fingers 60 (only one of which can be seen in FIG. 3) and a guide 64. As best illustrated in FIGS. 4 and 6, each of the folding fingers 60 includes an outwardly projecting contacting pin 70. The folding fingers 60 and the guide 64 are stationarily mounted on the frame structure 68 so that they do not rotate with the mounting arm 58. However, each of the folding fingers 60 is rotatably driven about its longitudinal axis 60′.

In operation, the folding fingers 60 continually rotate about their respective longitudinal axes 60′. The system is designed such that the rotation of the folding fingers 60, the rotation of the shaft 66, and the rotation of the mandrel 42 are all synchronized with one another. Since the details of the apparatus which allow that synchronized movement is known to persons in the art and does not form a specific part of the present invention, a description is not included here.

As the mandrel 42 rotates in the direction of the arrow A shown in FIG. 5 from the heating station to the sealing station, the shaft 66 rotates in the counterclockwise direction represented by the arrow B in FIG. 5. The synchronized rotation of the mandrel 42, the shaft 66 and the folding fingers 60 is such that the contacting pins 70 on the rotating folding fingers 60 come into contact with the second and fourth bottom panels 32, 36 of the carton blank 20 while the mandrel 42 is rotating as seen in FIGS. 4 and 6. As a result, the second and fourth bottom walls 32, 36 begin to fold inwardly.

At about the same time, the rotating mounting arm 58 has rotated to such an extent that the roller 57 on the tuck folder 56 comes into contact with the third bottom panel 34, thereby causing the third bottom panel 34 to begin folding inwardly towards the first bottom panel 30 as seen in FIG. 5. Because the mandrel 42 is rotating, the first bottom panel 30 of the carton blank 20 is brought into contact with the stationary guide 64 as illustrated in FIG. 5. That causes the first bottom panel 30 to begin folding inwardly towards the third bottom panel 34. Further, the rear surface 63 of the bending unit 62 and the bottom panel flap 35 are brought into contact with one another which causes the bottom panel flap 35 to fold outwardly away from the first bottom panel 30 as also shown in FIG. 9. The outward folding of the bottom panel flap 35 is also facilitated in some respects by the earlier prefolding that was imparted to the bottom panel flap 35 at the in-feed station.

The continued rotation of the mandrel 42 in the direction of the arrow A in FIG. 5, in combination with the continued rotation of the mounting arm 58 in the direction of the arrow B in FIG. 5 and the continued rotation of the folding fingers 60 about their axes 60′ results in substantial completion of the folding of the bottom panels. That is, the inward folding of the second and fourth bottom panels 32, 36 is substantially completed through continued rotation of the folding fingers 60. The synchronized rotation of the folding fingers 60 and the mandrel 42 helps ensure that when the mandrel 42, and thus the carton blank 20, have reached a certain point, the folding fingers 60 have rotated out of the way so that the contacting pins 70 do not interfere with further rotation of the mandrel and the carton blank 20. Likewise, continued rotation of the mounting arm 58 and the mandrel 42 substantially completes the inward folding of the third bottom panel 34, and the outward folding of the bottom panel flap 35.

Once the tuck folder 56 and the bending unit 62 have rotated out of the way, continued rotation of the mandrel 42 completes the folding of the first bottom panel 30 as a result of the contact between the stationary guide 64 and the first bottom panel 30. In that regard, the first bottom panel 30 is actually forced down onto the underlying bottom panels 32, 34, 36 and the bottom panel flap 35 by way of the guide 64. Thus, the final folding of the first bottom panel 30 completes the folding of the remaining bottom panels 32, 34, 36 and the bottom panel flap 35.

After the bottom panels have been folded, further rotation of the mandrel 42 advances the carton blank 20 to the sealing station where the bottom panels are sealed to form a bottom end wall of the carton. After sealing, the bottom end wall of the carton is formed such that the second and fourth bottom panels 32, 36 are located inwardly of the first and third bottom panels 30, 34 with respect to the interior of the carton. Further, the first bottom panel 30 overlaps a portion of the outwardly facing surface of the third bottom panel 34, and the bottom panel flap 35 is positioned between the third bottom panel 34 and the first bottom panel 30.

While useful in achieving folding of the carton blank shown in FIG. 1, the combination of the prefolding assembly shown in FIG. 2 and described above, and the bottom panel folding apparatus illustrated in FIGS. 3–6 and described above is susceptible of certain improvements. For example, with reference to FIG. 2, it has been found to be somewhat difficult to maintain precise tolerances with respect to the position of the bottom panel flap 35 relative to the carrier 52 and the prefolding block 54. As a result, it is not always possible to ensure that the crease line 37 about which the bottom panel flap 35 is to be folded is located precisely at the tip of the prefolding block 54. Consequently, it sometimes happens that the bottom panel flap 35 is prefolded about a line other than the crease line 37. As might be expected, such an improper prefolding of the bottom panel flap 35 can cause problems later on during the bottom folding step. For example, when the bottom panel flap 35 and the bending unit 62 are brought into contact with one another, the bottom panel flap 35 may tend to fold at two places—the crease line 37 and the crease formed by the improper prefolding of the bottom panel flap 35.

With reference to FIG. 3, another area of improvement involves the bending unit 62 that is employed to fold the bottom panel flap 35 outwardly upon the bottom panel 34. As seen in FIG. 5, when the mounting arm 58 is rotating in the direction of arrow B, the rear curved surface 63 at the distal free end of the bending unit 62 that contacts the bottom panel flap 35 is actually moving away from the bottom panel flap 35. That means that the force applied to the bottom panel flap 35 by the bending unit 62 may not be as effective as necessary to ensure that the bottom panel flap 35 is properly folded when the first bottom panel 30 forces the bottom panel flap 35 downwardly. More specifically, it has been found that the bending unit 62 releases the bottom panel flap 35 much too soon and as a result, there is too long a period of time in which the bottom panel flap 35 can move forwardly before being contacted by the inwardly and downwardly folding first bottom panel 30. Consequently, the bottom panel flap 35 may fold back towards the first bottom panel 30. If the bottom panel flap 35 folds back towards the first bottom panel 30 too far, the bottom panel flap 35 may not be properly folded when contacted by the first bottom panel 30.

SUMMARY OF THE PRESENT INVENTION

In light of the foregoing and to provide improvements in the aforementioned areas as well as others, the present invention provides an apparatus and method for folding bottom panels on a carton blank. In accordance with one aspect of the present invention, an apparatus is provided for forming cartons having an interior defined by side walls and a bottom end wall. The bottom end wall is formed of first and third bottom panels extending from opposite side walls, and second and fourth bottom panels extending from opposite side walls. The second and fourth bottom panels are located inwardly of the first and third bottom panels with respect to the interior of the carton, while the first bottom panel overlaps a portion of the outer surface of the third panel. The third bottom panel is also provided with a bottom panel flap that is folded with respect to the third bottom panel such that the bottom panel flap is positioned between the first bottom panel and the third bottom panel. The apparatus comprises a rotatable mandrel for receiving a carton whose bottom end wall is to be formed. The mandrel is rotatable between a plurality of stations including a carton loading station, a heating station for heating bottom panels of the carton, and a bottom sealing station for sealing the bottom panels. The apparatus also includes an arrangement for conveying the cartons to the mandrel at the carton loading station, and a bottom panel folding device for folding the bottom panels of the carton before they are sealed at the bottom sealing station. The bottom panel folding device includes an arrangement for inwardly folding the second and fourth bottom panels, another arrangement for inwardly folding the third bottom panel, and an arrangement for outwardly folding the bottom panel flap. The arrangement for outwardly folding the bottom panel flap includes a bending member that is provided with two oppositely curved portions so that the bottom panel flap is folded outwardly upon the third bottom panel when the bottom panel flap contacts the bending member.

In accordance with a preferred embodiment of the apparatus, the arrangement for inwardly folding the third bottom panel includes a tuck folder mounted on a mounting arm. The bending member is also secured to the mounting arm and includes first, second and third curved portions. The first and third curved portions are curved to provide convex surfaces that face in the direction of the tuck folder while the second curved portion is positioned between the first and third curved portions and defines a concave surface that faces towards the tuck folder. The bending member also includes a substantially straight portion positioned adjacent the mounting arm and obliquely disposed with respect to the mounted arm.

In accordance with another aspect of the present invention, an apparatus is provided for folding bottom panels of a carton blank so that the panels can be sealed to form a bottom end wall of a carton. The carton blank includes side walls, first and third bottom panels extending from opposite side walls, second and fourth bottom panels extending from opposite side walls, and a bottom panel flap extending from the third bottom panel. The apparatus comprises a frame, a rotatable supporting assembly, an arrangement mounted on the frame for inwardly folding said second and fourth bottom panels, a tuck folder mounted on the rotatable supporting assembly for inwardly folding the third bottom panel, an arrangement mounted on the frame for inwardly folding the first bottom panel, and a bending member that is mounted on the rotatable supporting assembly for outwardly folding the bottom panel flap. One portion of the bending member located between the distal and proximal ends of the bending member is curved to define a concave surface that faces the tuck folder and that is contacted by the bottom panel flap.

In accordance with the preferred embodiment of the present invention, the bending member includes a curved portion positioned on each side of the one curved portion, each of which defines a convex surface that faces in the direction of the tuck folder. The rotatable supporting assembly includes a mounting arm on which is mounted the bending member. The bending member includes a substantially straight portion that is positioned between the one curved portion and the mounting arm. The straight portion of the bending member is obliquely disposed with respect to the mounting arm.

In accordance with another aspect of the present invention, a method is provided for forming a bottom end wall on a carton having side walls that define an interior. The bottom end wall is comprised of first and third bottom panels which extend from opposite side walls, second and fourth bottom panels which extend from opposite side walls, and a bottom panel flap that extends from the third bottom panel. The method comprises placing a carton whose bottom end wall is to be formed on a mandrel, folding the second and fourth bottom panels inwardly towards one another, folding the first and third bottom panels inwardly towards one another, and folding the bottom panel flap outwardly away from the first bottom panel concurrently with the inward folding of the third bottom panel. The folding of the bottom panel flap occurs without prior prefolding of the bottom panel flap. The mandrel is then rotated to a sealing station where the bottom panels are sealed to form the bottom end wall so that the second and fourth panels are located inwardly of the first and third bottom panels with respect to the interior of the carton, and so that the bottom flap is positioned between the first and third bottom panels.

In the preferred embodiment of the method, the mandrel is rotating while the bottom panel flap and the first, second, third and fourth bottom panels are being folded. Further, the folding of the first and third panels, and the folding of the second and fourth bottom panels occurs concurrently.

BRIEF DESCRIPTION OF THE DRAWING FIGURES

Additional details of the apparatus and method according to the present invention will become more apparent from the description below, considered in conjunction with the accompanying drawing figures in which like elements bear like reference numerals and wherein.

DETAILED DESCRIPTION OF THE PREFERRED EMBODIMENT

Figure 1:
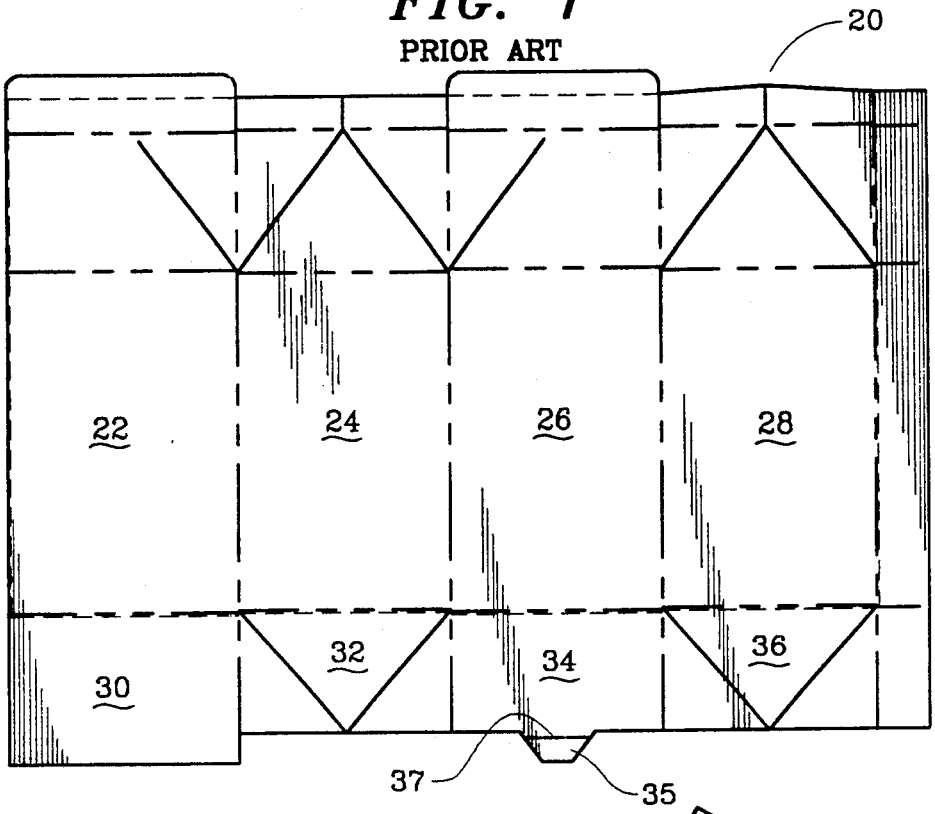
FIG. 1 PRIOR ART
FIG. 1 is a top plan view of another carton blank.
Figure 3:
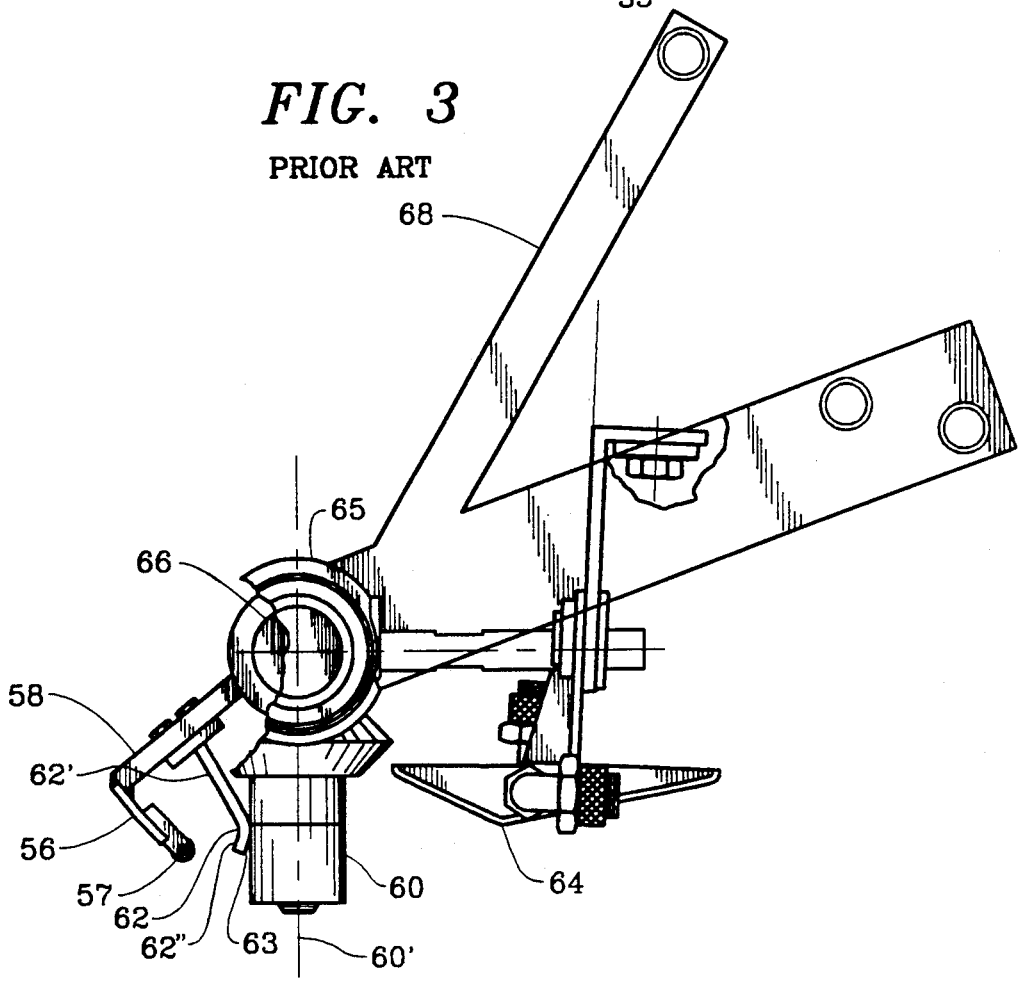
FIG. 3 PRIOR ART
FIG. 3 is a side view of a portion of a bottom panel folding apparatus.
Figure 7:
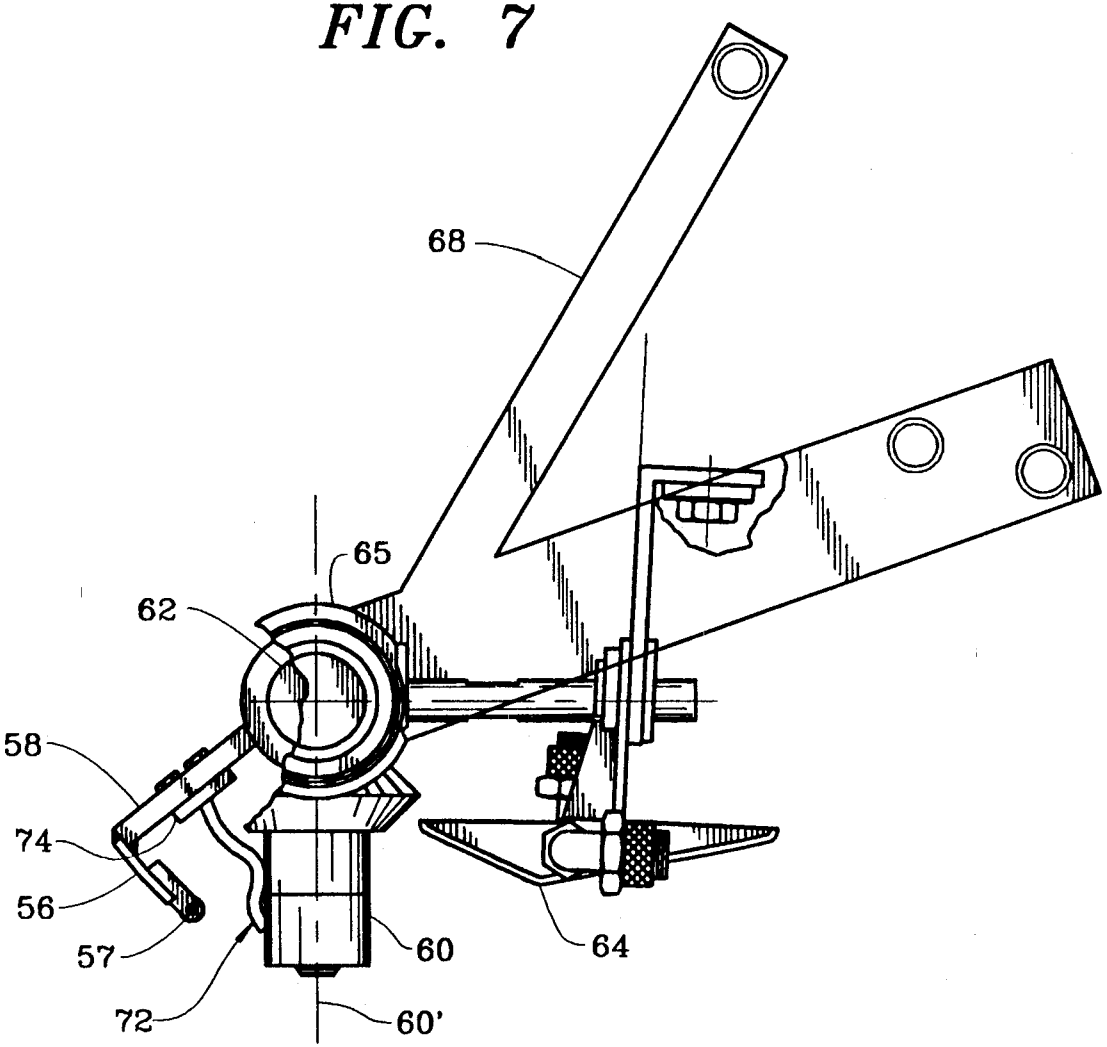
FIG. 7 is a side view of the bottom panel folding apparatus according to the present invention including the bending member.

With reference initially to FIG. 7, the bottom panel folding apparatus according to the present invention is similar in many respects to the bottom panel folding apparatus illustrated in FIG. 3. That is, the bottom folding apparatus of the present invention as seen in FIG. 7 includes a mounting arm 58 that is secured to a rotatably driven shaft 66 so that rotation of the shaft 66 causes rotation of the mounting arm 58. A tuck folder 56 is connected to the distal end of the mounting arm 58 for inwardly folding the third bottom panel 34 (see FIG. 1). Mounted at the distal free end of the tuck folder 56 is a roller 57 that is adapted to be brought into contact with the third bottom panel 34 in much the same way described above.

Two rotating folding fingers 60 (only one of which is visible in FIG. 7) are also provided and are mounted on the frame structure 68. Each of the folding fingers 60 includes a contacting pin for contacting and inwardly folding the second and fourth bottom panels 32, 36 in the manner described above. A guide 64 is also stationarily mounted on the frame structure 68 so that during rotation of the mandrel 42 and the carton blank 20, the first bottom panel 30 is brought into contact with the guide and is thereby folded inwardly as also described above.

The bottom panel folding apparatus of the present invention as illustrated in FIG. 7, differs from the bottom panel folding apparatus illustrated in FIG. 7 with respect to the bending member 72 that is connected to the mounting arm 58 for outwardly folding the bottom panel flap 35. Generally speaking, the bending member 72 includes a relatively stiff piece of material such as stainless steel that is connected to a mounting base 74 in any suitable manner such as by welding. The mounting base 74 is likewise secured to the mounting arm 58 in any suitable manner such as by way of screws.

Figure 8:
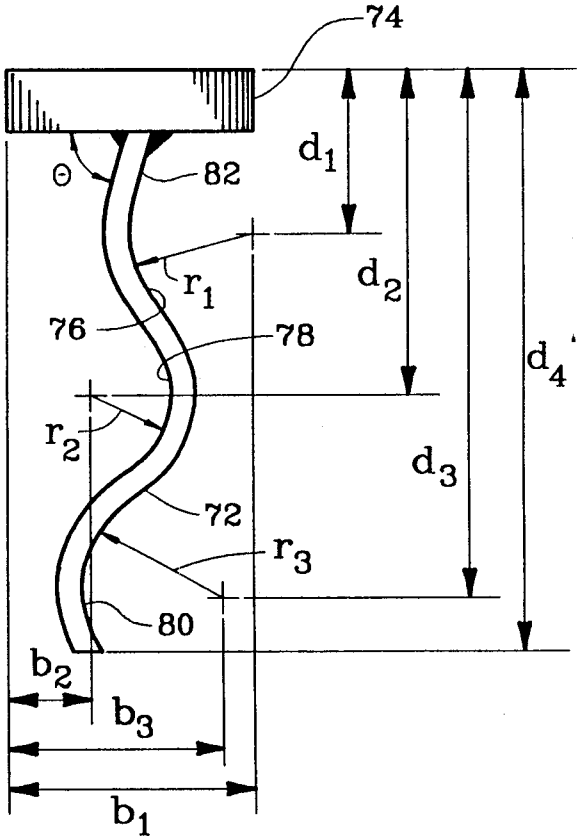
FIG. 8 is an enlarged side view of the bending unit according to the present invention that is utilized in the bottom panel folding apparatus.

Turning to FIG. 8, the features of the bending member 72 can be seen more clearly. The bending member 72 includes a first curved portion 76, a second curved portion 78, and a third curved portion 80. The first curved portion 76 defines a convex surface that faces towards or in the direction of the tuck folder 56, the second curved portion 78 defines a concave surface that faces towards the tuck folder 56, and the third curved portion 80 provides another convex surface that faces in the direction of the tuck folder 56. The bending member 72 further includes a substantially straight portion 82 which is secured to the mounting base 74 and which is positioned between the mounting base 74 and the first curved portion 76. The straight portion 82 is disposed obliquely (i.e., not perpendicular) with respect to the mounting base 74 so that the entire bending member 72 is angled towards the tuck folder 56. In that way, the straight portion 82 forms an angle $\theta$ with respect to the mounting base 74 and the mounting arm 58.

For purposes of illustration, the following are examples of dimensions for the bending member 72 that have been found to be useful. The angle $\theta$ can be approximately 76–77 degrees, the radius of curvature $r_1$ of the first curved portion 76 and the radius of curvature $r_2$ of the second curved portion 78 can be approximately 6.0 mm, the radius of curvature $r_3$ of the third curved portion 80 is preferably about 7.0 mm, the distance $d_1$ between the top of the mounting base 74 and the center of the radius of curvature $r_1$ of the first curved portion 76 can be approximately 10 mm, and the corresponding distances $d_2$, $d_3$ for the centers of the radii of curvature $r_2$, $r_3$ can be approximately 23.0–24.0 mm. and approximately 37.0–38.0 mm. respectively. Also, the total length of the bending member 72 can be approximately 43.0 mm, while the distances $b_1$, $b_2$, $b_3$ from the center of each radii of curvature $r_1$, $r_2$, $r_3$ to the left edge of the mounting base 74 can be approximately 15.0–16.0 mm., 7.0–8.0 mm., and 12.0–13.0 mm, respectively. Preferably, the bending member 72 is intended to be used with a tuck folder 56 and roller 57 arrangement that is slightly longer than the bending member 72.

Figure 2:
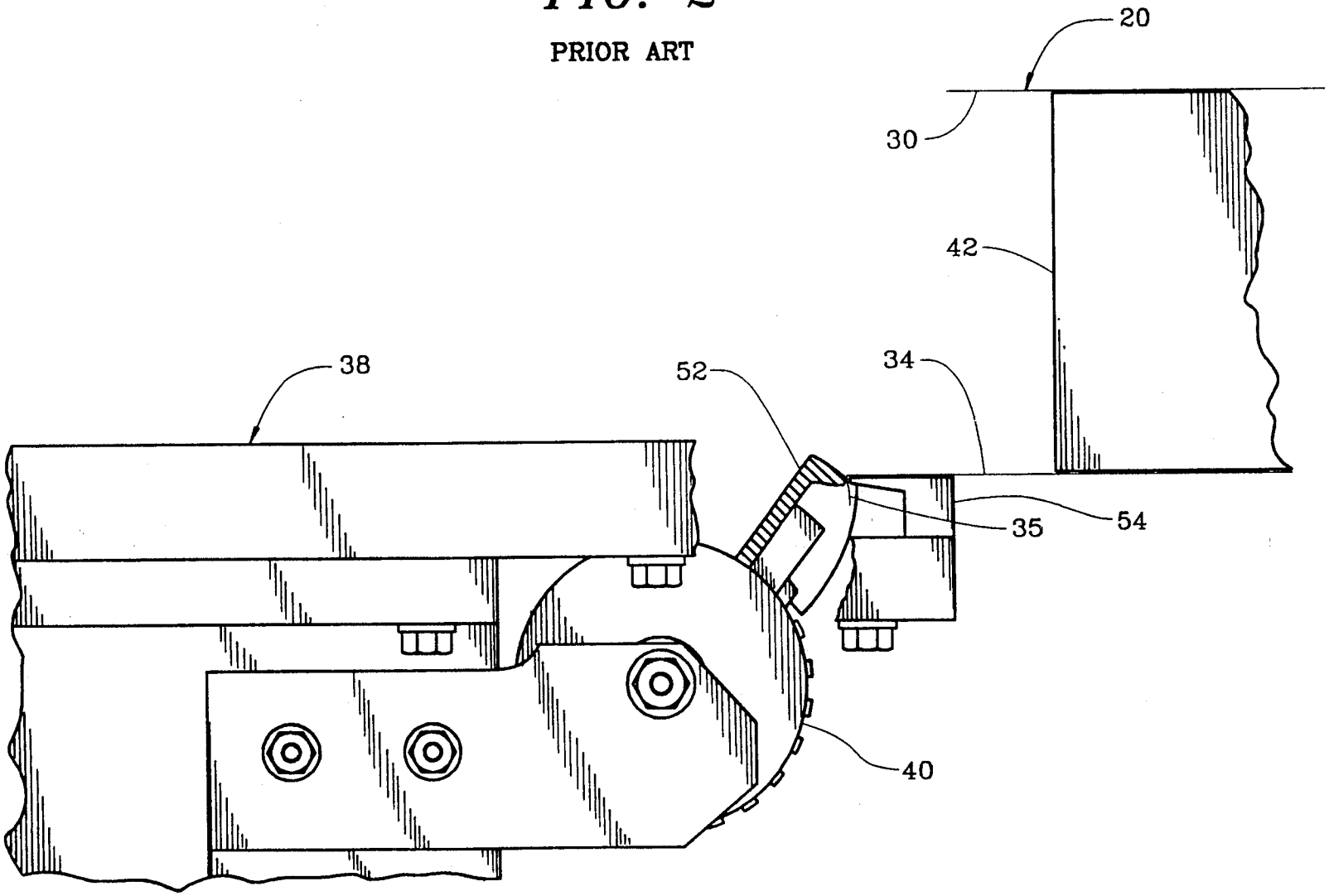
FIG. 2 PRIOR ART
FIG. 2 is an enlarged view of a portion of a bottom forming apparatus.

The bending member 72 in accordance with the present invention is quite advantageous as it results in a much more effective outward folding of the bottom panel flap 35. Moreover, the bending member 72 does away with the need to prefold the bottom panel flap 35 through use of the prefolding block 54 in combination with the carrier 52 as illustrated in FIG. 2. That is,-the use of a bending member 72 in accordance with the present invention requires no prefolding of the bottom panel flap 35 because the bending member 72 ensures that the bottom panel flap 35 is correctly folded. Further, the bending unit 62 illustrated in FIG. 3 can be easily removed and replaced with the bending member 72 illustrated in FIG. 8, thereby allowing existing machines to be upgraded as desired.

Figure 4:
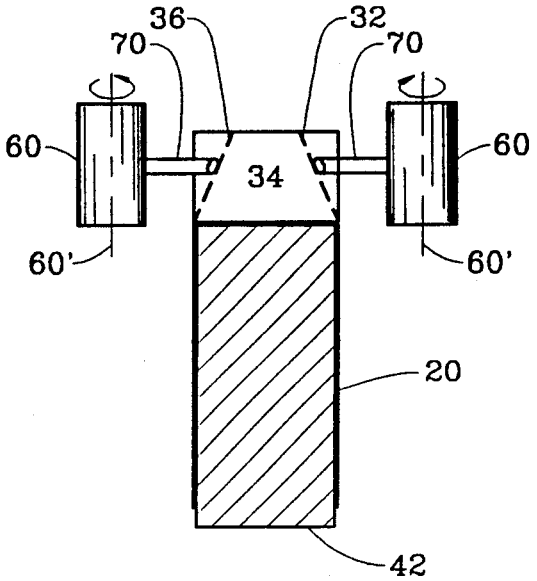
FIG. 4 PRIOR ART
FIG. 4 is a front view of a portion of the bottom panel folding apparatus illustrating the rotating folding fingers.
Figure 5:
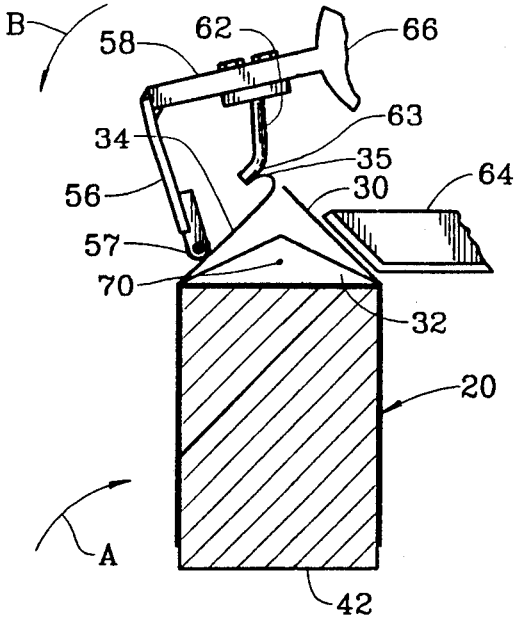
FIG. 5 PRIOR ART
FIG. 5 is a side view of a portion of the bottom panel folding apparatus illustrating the tuck folder, the bending unit and the guide.
Figure 6:
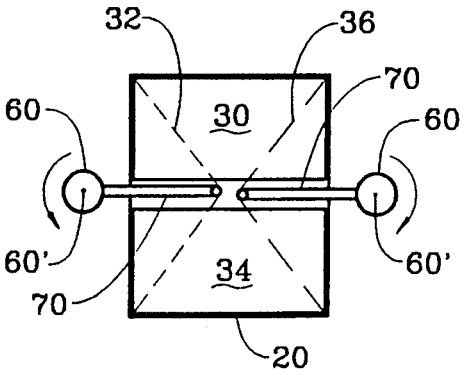
FIG. 6 PRIOR ART
FIG. 6 is a top view of a portion of the bottom panel forming apparatus illustrating the two rotatable folding fingers.
Figure 9:
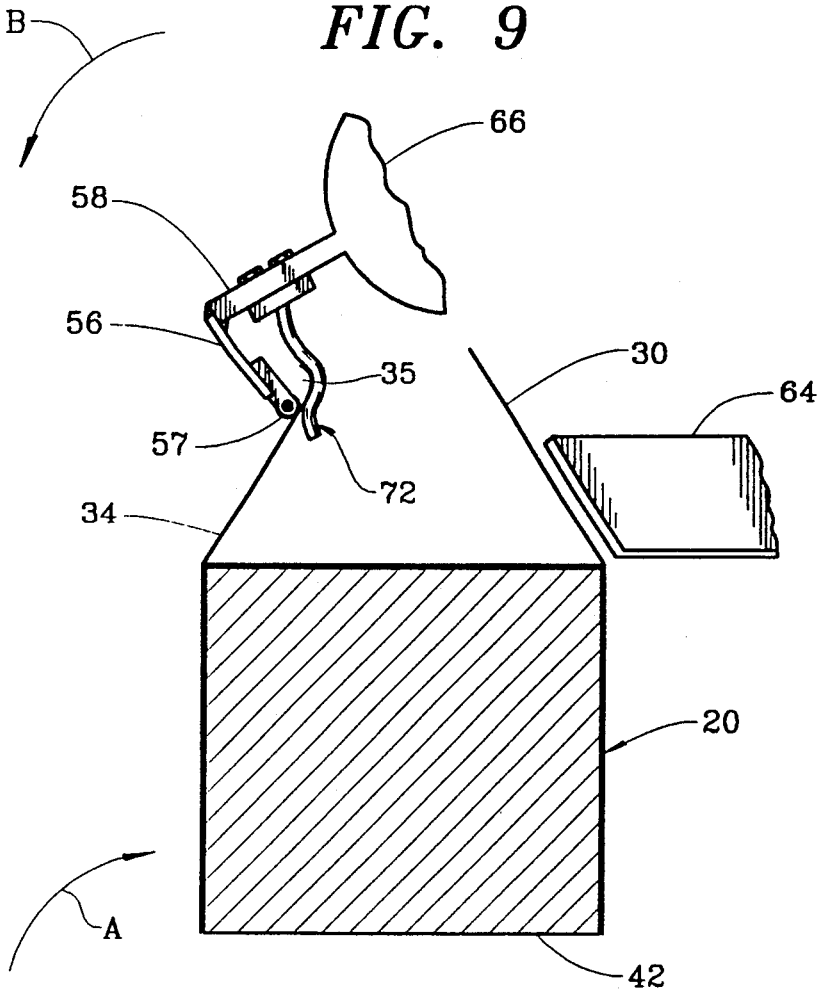
FIG. 9 is a side view of a portion of the bottom panel folding apparatus according to the present invention illustrating the tuck folder, the bending member and the guide.

Turning to FIG. 9, the synchronized rotation of the mandrel 42, the mounting arm 58 and the folding fingers 60 is similar to that described above. That is, after the heating of the bottom end panels is effected at the heating station, the mandrel 42 begins to rotate towards the bottom sealing station in the direction of the arrow A shown in FIG. 9. At the same time, the mounting arm 58 rotates in the direction of the arrow B illustrated in FIG. 9. The rotating movement of the mandrel 42, the mounting arm 58 and the folding fingers (see FIG. 4) is synchronized such that the contacting pins on the folding fingers rotate into position and contact the second and fourth bottom panels 32, 36. The rotating movement of the folding fingers causes the second and fourth bottom panels 32, 36 to fold inwardly towards one another.

At about the same time, the roller 57 on the tuck folder 56 comes into contact with the third bottom panel 34 and begins to fold the third bottom panel 34 inwardly towards the first bottom panel 30. Also, the bottom panel flap 35 contacts or is contacted by the concave surface formed by the second curved portion 78, thereby causing the bottom panel flap 35 to follow the contour of the concave surface and fold outwardly away from the first bottom panel 30 along the crease line 37. Approximately concurrently therewith, the first bottom panel 30 contacts the stationary guide 64 as a result of the rotating movement of the mandrel 42, thereby causing the first bottom panel 30 to begin folding inwardly towards the third bottom panel 34. The mandrel 42 continues to rotate in the direction of the arrow A, while the mounting arm 58 continues to rotate in the direction of the arrow B. As a result, the roller 57 continues to force the third bottom panel 34 inwardly. Since the bending member 72 is also rotating with the mounting arm 58, the outwardly folded bottom panel flap 35 begins to slide along the bending member 72 where it continues to be forced outwardly by the convex surface formed by the third curved portion 80.

By the time the folding operation is just about completed, the contacting pins on the folding fingers will have rotated out of the way of the carton 20. The distal free end of the bending member 72, however, continues to force the bottom panel flap 35 outwardly and downwardly to ensure that when the first bottom panel 30 is folded on top of the third bottom panel 34, the bottom panel flap 35 is positioned between the third bottom panel 34 and the first bottom panel 30. Continued rotation of the mandrel 42 conveys the carton with the inwardly folded bottom panels 30, 32, 34, 36 and the outwardly folded bottom panel flap 35 to the sealing station where the bottom panels are sealed to form a sealed bottom end wall of the carton.

Figure 10:
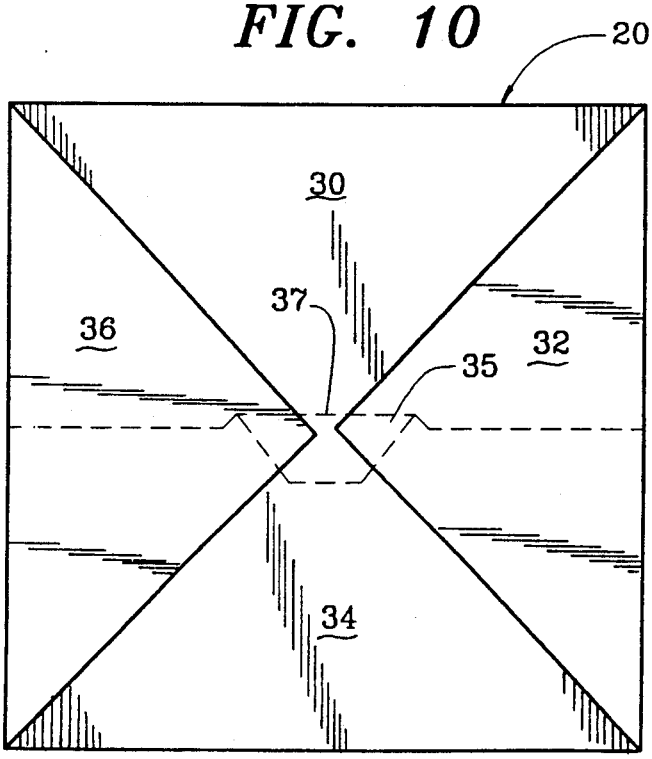
FIG. 10 is a top view of the interior of an empty carton formed from the carton blank shown in FIG. 1 showing the bottom end wall of the carton.

The shape and configuration of the bending member 72 is quite advantageous because, as noted above, it negates the need for the prefolding step previously utilized. The concave surface defined by the second curved portion 78 and the way in which that concave surface merges into the convex surface defined by the first curved portion 76, produces the initial outward folding of the bottom panel flap 35. Further, because the straight portion of the bending member 72 is obliquely disposed with respect to the mounting arm 58, the entire bending member 72 is angled back towards the tuck folder 56. As a result, during rotational movement of the mounting arm 58, the bending member 72 stays in contact with the bottom panel flap 35 for a longer period of time as compared to the bending unit 62 illustrated in FIG. 3. Indeed, during rotational movement of the mounting arm, the bending member 72 continually forces the bottom panel flap 35 outwardly and then downwardly to ensure that when the first bottom panel 30 is forced downwardly onto the bottom panels 32, 34, 36 and the bottom panel flap 35, the bottom panel flap 35 will be disposed between the third bottom panel 34 and the first bottom panel 30 as illustrated in FIG. 10. Simply stated, since the bending member 72 is in contact with the bottom panel flap 35 for a longer period of time, the bottom panel flap 35 is forced to stay in the correct position for a longer period of time. Consequently, it is possible to ensure that the bottom panel flap 35 is positioned relative to the first bottom panel 30 in such a manner that the bottom panel flap 35 is folded outwardly and forced downwardly when contacted by the first bottom panel 30. Thus, in addition to negating the need for a prefolding arrangement for the bottom panel flap 35, the bending member 72 also provides better assurance that the bottom panel flap 35 will be properly folded.

While this invention has been illustrated in accordance with a preferred embodiment, it is recognized that variations and changes may be made, and equivalence employed herein, without departing from the invention as set forth in the claims.

What we claim is:

1. An apparatus for forming cartons having an interior defined by side walls and a bottom end wall, said bottom end wall being formed by first and third bottom panels extending from opposite side walls, and second and fourth bottom panels extending from opposite side walls, said second and fourth bottom panels being located inwardly of the first and third bottom panels with respect to the interior of the carton, and said third bottom panel being provided with a bottom panel flap that is folded with respect the third bottom panel such that the bottom panel flap is positioned between the first bottom panel and the third bottom panel, the apparatus comprising:

a rotatable mandrel for receiving a carton whose bottom end wall is to be formed, said mandrel being rotatable between a plurality of stations including a carton receiving station at which a carton is received on the mandrel, a heating station for heating the bottom panels of the carton, and a bottom sealing station for sealing the heated bottom panels;

means for conveying cartons to the mandrel at the carton receiving station;

a bottom panel folding device for folding the bottom panels of the carton before they are sealed at the bottom sealing station, said bottom panel folding device including means for inwardly folding the second and fourth bottom panels towards one another, means for inwardly folding the third bottom panel towards the first bottom panel, means for inwardly folding the first bottom panel towards the third bottom panel, and means for outwardly folding the bottom panel flap away from the first bottom panel, said means for outwardly folding the bottom panel flap including a bending member having two oppositely curved portions along one surface of the bending member so that the bottom panel flap is folded outwardly when the bottom panel flap contacts the bending member.

2. The apparatus according to claim 1, wherein said bending member includes first, second and third curved portions, the first and third curved portions defining convex surfaces that face in the direction of said means for inwardly folding the third bottom panel, said second curved portion being positioned between said first and third curved portions and defining a concave surface that faces in the direction of said means for folding the third bottom panel.

3. The apparatus according to claim 2, wherein said means for folding the third bottom panel includes a tuck folder mounted on a rotatable mounting arm, said tuck folder being provided with a roller at a distal end thereof for contacting the third bottom panel, said bending member being mounted on said mounting arm to rotate with said tuck folder.

4. The apparatus according to claim 3, wherein said bending member includes a substantially straight portion positioned adjacent a proximal end of said bending member closest to said mounting arm, said first curved portion being positioned adjacent said substantially straight portion and said third curved portion being located adjacent a distal free end of said bending member.

5. The apparatus according to claim 4, wherein said substantially straight portion is obliquely disposed with respect to said mounting arm.

6. The apparatus according to claim 5, wherein said substantially straight portion extends in the direction of said tuck folder to form an acute angle with respect to said mounting arm, said second and third curved portions having a different radius of curvature.

7. An apparatus for folding bottom panels of a carton blank so that the bottom panels can be sealed to form a sealed bottom end wall of a carton, said carton blank including side walls, first and third bottom panels extending from opposite side walls, second and fourth bottom panels extending from opposite side walls, and a bottom panel flap extending from said third bottom panel, the apparatus comprising a frame, a rotatable supporting assembly mounted on said frame, means mounted on said frame for inwardly folding said second and fourth bottom panels towards one another, a tuck folder mounted on said rotatable supporting assembly for inwardly folding said third bottom panel toward said first bottom panel, means mounted on said frame for inwardly folding said first bottom panel toward said third bottom panel, and a bending member mounted on said rotatable supporting assembly for outwardly folding said bottom panel flap away from said first bottom panel, said bending member including a distal free end and an oppositely positioned proximal supporting end, said bending member including one curved portion positioned intermediate said distal and proximal ends, said one curved portion defining a concave surface that faces in the direction of said tuck folder and that contacts said bottom panel flap to fold the bottom panel flap outwardly away from the first bottom panel.

8. The apparatus according to claim 7, wherein said bending member includes a curved portion positioned on each side of said one curved portion which defines a convex surface that faces in the direction of said tuck folder.

9. The apparatus according to claim 7, wherein said rotatable supporting assembly includes a mounting arm on which is mounted said bending member, said bending member including a substantially straight portion positioned between said one curved portion and said mounting arm, said straight portion of said bending member being obliquely disposed with respect to said mounting arm.

10. The apparatus according to claim 9, wherein said bending member includes another curved portion positioned between said substantially straight portion and said one curved portion, said another curved portion defining a convex surface that faces in the direction of said tuck folder.

11. The apparatus according to claim 9, wherein said bending member includes another curved portion positioned adjacent the distal free end of said bending member, said another curved portion defining a convex surface that faces in the direction of said tuck folder.

12. The apparatus according to claim 7, wherein said tuck folder includes a roller mounted on a distal free end thereof for contacting the third bottom panel, said means for inwardly folding said second and fourth bottom panels towards one another includes two spaced apart rotatable folding fingers, one of said rotatable folding fingers contacting and inwardly folding said second bottom panel and the other folding finger contacting and inwardly folding said fourth bottom panel.

13. The apparatus according to claim 7, wherein said bending member includes another curved portion having a radius of curvature that is different from a radius of curvature of said one curved portion.

14. A method of forming a bottom end wall on a carton having side walls that define an interior, the bottom end wall being comprised of first and third bottom panels which extend from opposite side walls, second and fourth bottom panels which extend from opposite side walls, and a bottom panel flap that extends from the third bottom panel, the method comprising:

placing a carton whose bottom end wall is to be formed on a rotating mandrel;

folding the second and fourth bottom panels inwardly towards one another;

folding the first and third bottom panels inwardly towards one another;

folding the bottom panel flap outwardly away from said first bottom panel concurrently with the inward folding of the third bottom panel, said bottom panel flap being folded by bringing the bottom panel flap into contacting engagement with a concavely curved surface of a bending member so that said concavely curved surface urges the bottom panel flap away from said first bottom panel.

rotating the mandrel to a bottom panel sealing station; and sealing the bottom panels to one another at the bottom panel sealing station to form the bottom end wall of the carton so that the second and fourth bottom panels are located inwardly of the first and third bottom panels with respect to the interior of the carton, and so that the bottom panel flap is positioned between the first and third bottom panels.

15. The method according to claim 14, wherein the inward folding of the first and third panels, and the inward folding of the second and fourth panels occurs concurrently.

16. The method according to claim 14, wherein said mandrel is rotating while said bottom panel flap and said first, second, third and fourth bottom panels are being inwardly folded.

17. The method according to claim 16, wherein the folding of the bottom panel flap and the first, second, third and fourth bottom panels is achieved by rotating a bottom panel folding apparatus such that a rotating folding finger contacts each of the second and fourth bottom panels, a tuck folder contacts the third bottom panel, the first bottom panel contacts a guide, and a bending member contacts the bottom panel flap, the rotation of the bottom folding apparatus occurring concurrently with said rotation of the mandrel.

18. The method according to claim 14, wherein the the bottom panel flap contacts the concavely curved surface of the bending member while the bending member is moving.

19. The method according to claim 18, wherein, after being contacted with the concavely curved surface of the bending member, the bottom panel flap is folded outwardly away from the first bottom panel by being contacted with a convexly curved surface on the bending member.

* * * * *